United States Patent [19]

Langenbach et al.

[11] Patent Number: 4,887,986

[45] Date of Patent: Dec. 19, 1989

[54] SURF-RIDING BOARD OR SAILING BOARD

[75] Inventors: Michael Langenbach, Lindau; Dirk Cremer; Reinhard Koppen, both of Neustadt, all of Fed. Rep. of Germany

[73] Assignee: Mistral Windsurfing AG, Bassersdorf, Switzerland

[21] Appl. No.: 185,388

[22] Filed: Apr. 25, 1988

[30] Foreign Application Priority Data

Apr. 25, 1987 [DE] Fed. Rep. of Germany ... 8705999[U]
May 15, 1987 [DE] Fed. Rep. of Germany ... 8707018[U]
Aug. 6, 1987 [DE] Fed. Rep. of Germany ..... 3736006

[51] Int. Cl.[4] ..... A63C 15/05

[52] U.S. Cl. ..... 441/74; 114/39.2; 441/65

[58] Field of Search ..... 441/65, 74, 79; 114/39.2

[56] References Cited

U.S. PATENT DOCUMENTS

| | | | |
|---|---|---|---|
| 3,879,782 | 4/1975 | Oliver | 441/74 |
| 3,902,207 | 9/1975 | Tinkler et al. | 441/74 |
| 3,929,549 | 12/1975 | Smith | 441/74 |
| 4,649,847 | 3/1987 | Tinkler et al. | 441/74 |
| 4,667,619 | 5/1987 | Nishida | 114/270 |

FOREIGN PATENT DOCUMENTS

| | | | |
|---|---|---|---|
| 3211887 | 10/1983 | Fed. Rep. of Germany | 441/74 |
| 2582281 | 11/1986 | France | 441/74 |

*Primary Examiner*—Sherman D. Basinger
*Assistant Examiner*—Thomas J. Brahan
*Attorney, Agent, or Firm*—Oblon, Spivak, McClelland, Maier & Neustadt

[57] ABSTRACT

A surf-riding board or sailing board comprises two flexible side portions having a stabilizing effect upon the board in difficult water conditions and during maneuvering.

29 Claims, 3 Drawing Sheets

SURF-RIDING BOARD OR SAILING BOARD

FIELD OF THE INVENTION

This invention relates to a surf-riding board or sailing board.

BACKGROUND OF THE INVENTION

Ever since surf-riding boards and sailing boards (hereinafter referred to merely as "boards") have been built, their builders have tried to obtain a more perfect adaption to different demands by providing the boards with an individual form. As variables, in the first place, the length, the width, the outward shape of the board, the disposition of the thickness (volume), the shape of the part below the water line in the longitudinal direction, and the shape of the part below the water line in cross section have been studied. These variables can be combined in many different ways to influence the sailing qualities of the board.

Also, a flexible design of the shape of the part below the water line in the longitudinal direction has been considered. In this connection, see the magazine Surf No. 8/1985 at pages 30 and 31 (Delius Klasing & Co., Siekerwall 21, 4800 Bielefeld, West Germany). However, so far a design as depicted in that magazine article could not be realized.

By an exploitation of the variables listed above, a rather good adaption of the boards to the specific requirements (speed, maneuvering capability, all around qualities, rocking stability, etc.) could be reached. However, this adaption was reached at the expense of other qualities. The more a board was constructed in view of a certain task, the more other aspects had to be neglected.

OBJECT OF THE INVENTION

The invention is based on the object of maintaining the form of the conventional boards, while, nevertheless, rendering them more stable in use and improving their sailing qualities.

SUMMARY OF THE INVENTION

According to the invention, the foregoing problem is solved by the fact that such a board consists of an inflexible floating body and two flexible side portions integrated into the inflexible floating body. The inflexible floating body preferably extends from the stern to the mast foot. Between the side portions, the inflexible floating body preferably tapers in the form of a narrow bridge Additionally, the flexible side portions are preferably rigidly connected to the inflexible floating body, having a base portion (called a "resilient carrier") consisting of an inflexible laminate of synthetic material and a resilient filling material consisting of a synthetic material or a rubber material. The flexible side portions can be formed so that the inflexible floating body, from the bridge to the edge of the board, is designed in such a way that this part of the board can resiliently deform.

ADVANTAGES OF THE INVENTION

The progress of the invention is to be seen in the improved sailing qualities of the boards. In comparison with conventional boards, a board with flexible side portions, due to the springy and cushioning effect of the resilient foam core, runs more calmly and provides a better maneuverability, an improve jumping quality, and a better sailing comfort. By means of the flexible side portions, it is possible to construct boards that are both fast and highly maneuverable.

DETAILED DESCRIPTION OF THE PRESENTLY PREFERRED EMBODIMENTS

The First Embodiment

Figure 1:
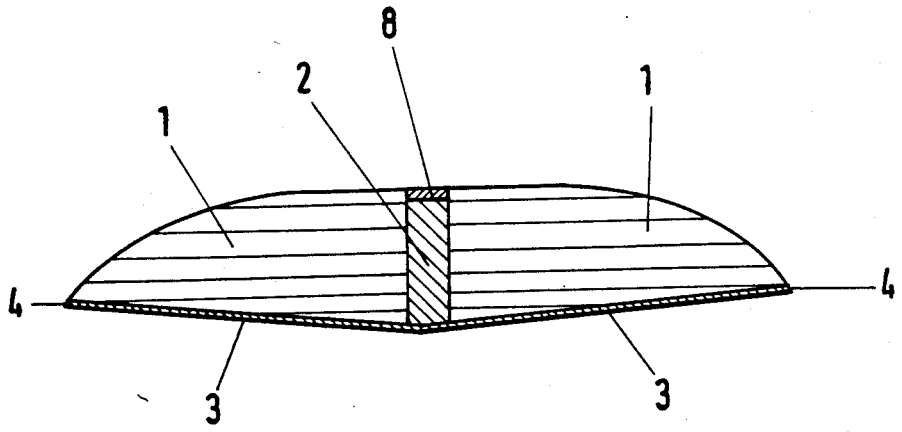
FIG. 1 is a cross section through a first embodiment of the board along the line I—I in FIG. 2.
Figure 2:
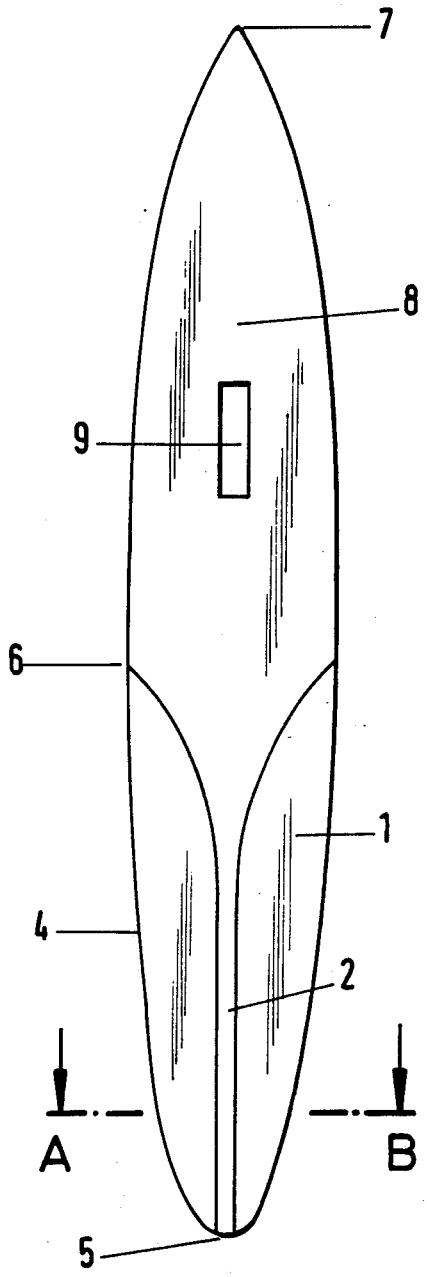
FIG. 2 is a bottom view (i.e., a view onto the undersurface of the first embodiment of the board).

The reference numeral 7 identifies the prow, and the reference numeral 5 identifies the stern of a board. The reference numeral 9 identifies the mast foot. The inflexible floating body is identified by the reference numeral 8, and the flexible side portions are identified by the reference numeral 1. The reference numeral 4 identifies the outward edges of the flexible side portions 1, and the reference numeral 2 identifies a narrow bridge to which the inflexible floating body 8 tapers continuously from the whole width of the board at symmetrical points 6 about one-half and preferably approximately 52% of the overall length of the board from the prow 7 to a width of about 3 cm at a point 10 about two-thirds and preferably approximately 69% of the overall length of the board from the prow 7. Both side portions 1 follow the bridge 2 on one side and, on the other side, the outline of a normal board.

FIG. 1 shows the flexible side portions 1. The reference numeral 3 identifies a thin, flexible laminate of synthetic material fixed to the base of the narrow bridge 2. The hollow space between the thin, flexible laminate 3 and the narrow bridge 2 is filled by a resilient, cushioning material such as an artificial foam. The flexible side portions 1 extend from the stern over a length of at least 20 cm towards the front. In an alternative embodiment (not shown), the flexible side portions 1 can extend up to the mast foot 9.

During the movement of the board, the flexible side portions 1 adapt to the waves and different water resistances due to their resilient deformability and provide a good stability to the board.

The Second Embodiment

Figure 4:
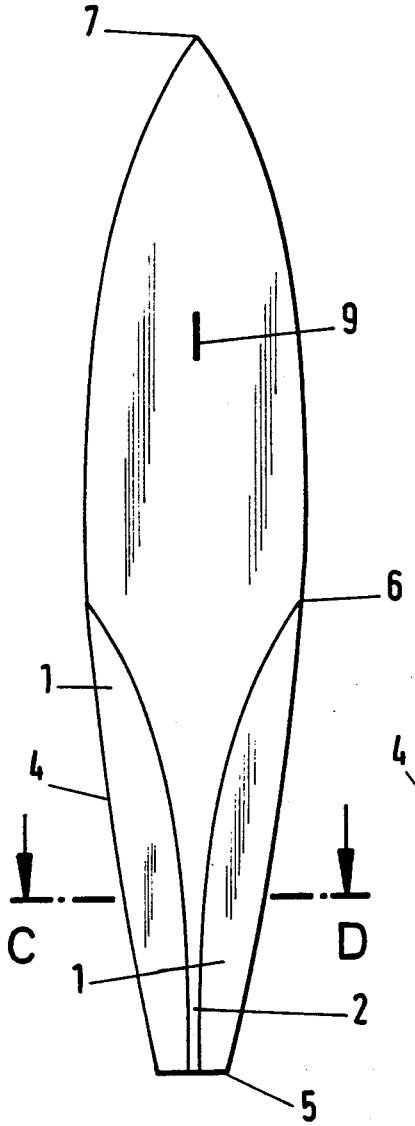
FIG. 4 is a bottom view (i.e., a view onto the undersurface of the second embodiment of the board).
Figure 3:
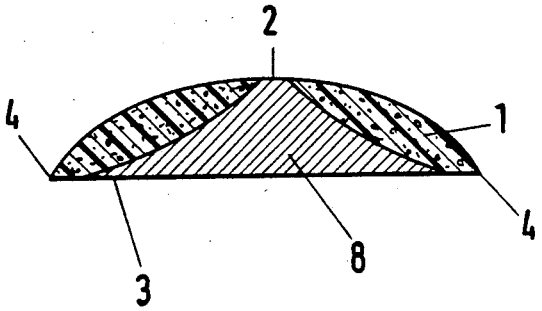
FIG. 3 is a cross section through a second embodiment of the board along the line III—III in FIG. 4.

In the embodiment according to FIGS. 3 and 4, the inflexible floating body 8 tapers within the range of the flexible side portions 1 from the outward edges 4 to the narrow bridge 2, as can be seen best from the cross sectional representation in FIG. 3. The part of the complete body eliminated by the tapering is replaced by a flexible material, preferably a resilient synthetic material The narrow bridge 2 tapers to a width of 3 cm. Due to the remaining narrow bridge 2, from which the tapering on both sides to the outward edges 4 of the board starts, the shape of the board's part below the water line in the longitudinal direction remains essentially stable, whereas the shape of the board's part below the water line in cross section deforms in response to pressure, returning to its original form when the pressure decreases.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A surf-riding board or sailing board comprising:

(a) an inflexible floating body having a stern and a prow;

(b) two flexible side portions attached to said inflexible floating body, one on either side thereof; and (c) a mast foot located on said inflexible floating body, wherein:

(d) said flexible side portions are incorporated into said flexible floating body from the stern to about the range of said mast foot and (e) said inflexible floating body tapers between said flexible side portions in the direction of said stern to become a narrow bridge that is narrower than each of said flexible side portions.

2. A surf-riding board or sailing board according to claim 1 wherein said inflexible floating body, within the range of said flexible side portions, from said narrow bridge up to said outward edges of said board, is designed in such a way that this part of the board can resiliently deform.

3. A surf-riding board or sailing board according to claim 2 wherein said inflexible floating body, within the range of said flexible side portions, tapers from said narrow bridge in the direction of said outward edges.

4. A surf-riding board or sailing board according to claim 3 wherein the part of said inflexible floating body eliminated by the tapering is replaced by said flexible side portions.

5. A surf-riding board or sailing board according to claim 4 wherein said flexible side portions are made of a resilient synthetic resin.

6. A surf-riding board or sailing board according to claim 1 wherein said narrow bridge has a minimum width of 3 cm.

7. A surf-riding board or sailing board according to claim 1 wherein said flexible side portions comprise a flexible carrier and a resilient filling material.

8. A surf-riding board or sailing board according to claim 7 wherein said flexible carrier comprises a laminate of synthetic material.

9. A surf-riding board or sailing board according to claim 7 wherein said resilient filling material is selected from the group consisting of foam material and rubber material.

10. A surf-riding board or sailing board according to claim 1 wherein said flexible side portions extend from the stern forward at least 20 cm.

11. A surf-riding board or sailing board as recited in claim 1 wherein said flexible side portions extend from the stern to a point at least approximately one-half of the overall length of the board from the prow.

12. A surf-riding board or sailing board as recited in claim 11 wherein said inflexible floating body tapers between said flexible side portions in the direction of said stern to become a narrow bridge at a point at least approximately two-thirds of the overall length of the board from the prow.

13. A surf-riding board or sailing board as recited in claim 1 wherein said flexible side portions extend from the stern to a point at least approximately 52% of the overall length of the board from the prow.

14. A surf-riding board or sailing board as recited in claim 13 wherein said inflexible floating body tapers between said flexible side portions in the direction of said stern to become said narrow bridge at a point at least approximately 69% of the overall length of the board from the prow.

15. A surf-riding board or sailing board comprising an inflexible floating body and a flexible stern portion, said surf-riding board or sailing board characterized in that:

(a) said inflexible floating body, at least at the upper part of the board, tapers in the rear portion of the board to a narrow bridge extending up to the stern and (b) flexible side portions are integrated into the board on both sides of this tapering.

16. A surf-riding board or sailing board according to claim 15 wherein:

(a) said surf-riding board or sailing board further comprises a mast foot and (b) said flexible side portions are incorporated into said inflexible floating body from the stern to about the range of said mast foot.

17. A surf-riding board or sailing board according to claim 15 wherein said inflexible floating body, within the range of said flexible side portions, from said narrow bridge up to the outward edges of said board, is designed in such a way that this part of the board can resiliently deform.

18. A surf-riding board or sailing board according to claim 17 wherein said inflexible floating body, within the range of said flexible side portions, tapers from said narrow bridge in the direction of said outward edges.

19. A surf-riding board or sailing board according to claim 18 wherein the part of said inflexible floating body eliminated by the tapering is replaced by said flexible side portions.

20. A surf-riding board or sailing board according to claim 19 wherein said flexible side portions are made of a resilient synthetic resin.

21. A surf-riding board or sailing board according to claim 15 wherein said narrow bridge has a minimum width of 3 cm.

22. A surf-riding board or sailing board according to claim 15 wherein said flexible side portions comprise a flexible carrier and a resilient filling material.

23. A surf-riding board or sailing board according to claim 22 wherein said flexible carrier comprises a laminate of synthetic material.

24. A surf-riding board or sailing board according to claim 22 wherein said resilient filling material is selected from the group consisting of foam material and rubber material.

25. A surf-riding board or sailing board according to claim 15 wherein said flexible side portions extend from the stern forward at least 20 cm.

26. A surf-riding board or sailing board as recited in claim 15 wherein said flexible side portions extend from the stern to a point at least approximately one-half of the overall length of the board from the prow.

27. A surf-riding board or sailing board as recited in claim 26 wherein said inflexible floating body tapers between said flexible side portions in the direction of said stern to become a narrow bridge at a point at least approximately two-thirds of the overall length of the board from the prow.

28. A surf-riding board or sailing board as recited in claim 15 wherein said flexible side portions extend from the stern to a point at least approximately 52% of the overall length of the board from the prow.

29. A surf-riding board or sailing board as recited in claim 28 wherein said inflexible floating body tapers between said flexible side portions in the direction of said stern to become said narrow bridge at a point at least approximately 69% of the overall length of the board from the prow.

* * * * *

UNITED STATES PATENT AND TRADEMARK OFFICE

CERTIFICATE OF CORRECTION

PATENT NO. : 4,887,986

DATED : Dec. 19, 1989

INVENTOR(S) : Michael Langenbach, et al

It is certified that error appears in the above-identified patent and that said Letters Patent is hereby corrected as shown below:

On the title page:

The third Foreign Application Priority Data is incorrectly recorded "Aug. 6, 1987 [DE] Fed Rep Germany...3736006.9" should be:

--Aug 6, 1987 [DE] Fed Rep Germany...3726066.9--

Signed and Sealed this

Twenty-third Day of April, 1991

*Attest:*

*Attesting Officer*

HARRY F. MANBECK, JR.

*Commissioner of Patents and Trademarks*